US006170504B1

(12) United States Patent
Tsai

(10) Patent No.: US 6,170,504 B1
(45) Date of Patent: Jan. 9, 2001

(54) TENT FRAME

(76) Inventor: Zung-Lin Tsai, No. 54-17, Huanya, Huanya Li, Yenshui Chen, Tainan Hsien (TW)

( * ) Notice: Under 35 U.S.C. 154(b), the term of this patent shall be extended for 0 days.

(21) Appl. No.: 09/350,745

(22) Filed: Jul. 9, 1999

(51) Int. Cl.[7] ..... E04H 15/40

(52) U.S. Cl. ..... 135/121; 135/128; 135/132; 135/133

(58) Field of Search ..... 135/121, 124, 135/125, 126, 132, 133, 135, 136, 138, 128

(56) References Cited

U.S. PATENT DOCUMENTS 3,990,463 * 11/1976 Norman .
4,265,259 * 5/1981 Gillis .
4,825,892 * 5/1989 Norman .
4,877,044 * 10/1989 Cantwell et al. .
5,137,044 * 8/1992 Brady .
5,285,804 * 2/1994 Gretzmacher .
5,709,428 * 1/1998 Hugghins ..... 135/127 X
5,816,278 * 10/1998 Kim ..... 135/126

* cited by examiner

*Primary Examiner*—Robert W. Gibson, Jr.
(74) *Attorney, Agent, or Firm*—William E. Pelton, Esq.

(57) ABSTRACT

An improved tent frame is disclosed. The tent frame includes a connector, a first curved flexible strap and a second curved flexible strap. The tent frame is composed of a first receptacle having a first end and a second end thereof, and a second receptacle having a first end and a second end thereof, with the receptacles pivotally connected to each other substantially at midpoints thereof. The first curved flexible strap has a first end attachable to the first end of the first receptacle and a second end attachable to the first end of the second receptacle. The second curved flexible strap has a first end attachable to the second end of the first receptacle and a second end attachable to the second end of the second receptacle. The curved flexible straps are configured so that an empty space sufficient to accommodate at least one user is formed between the curved flexible straps after the ends of the curved flexible straps are attached to the ends of the receptacles of the connector.

2 Claims, 8 Drawing Sheets

FIG.4
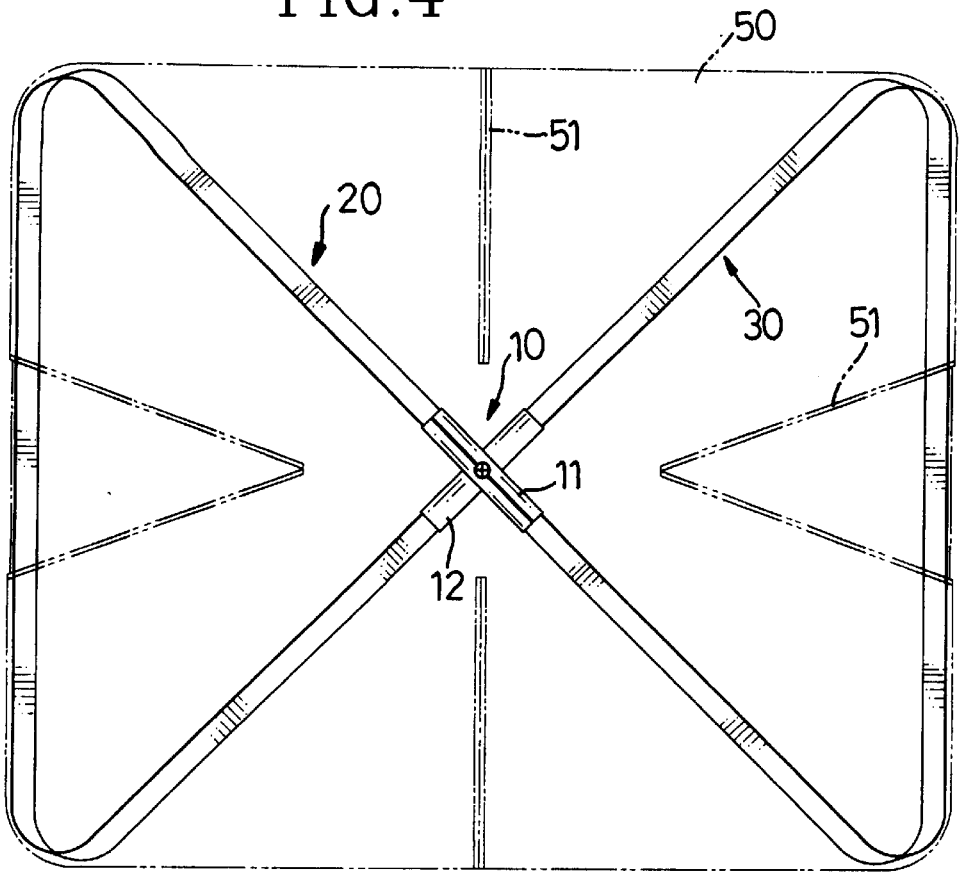
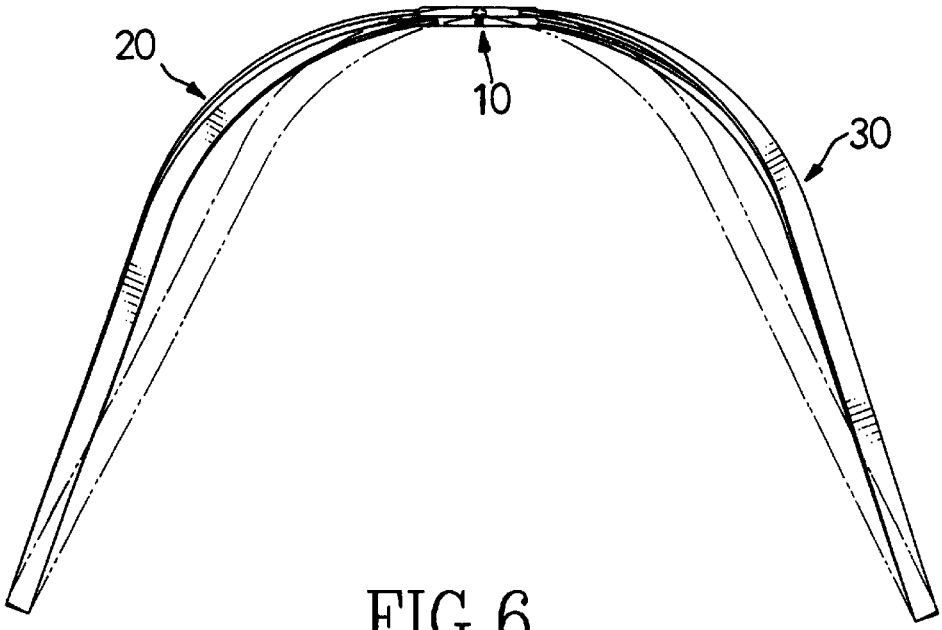
FIG.6

FIG.9
PRIOR ART
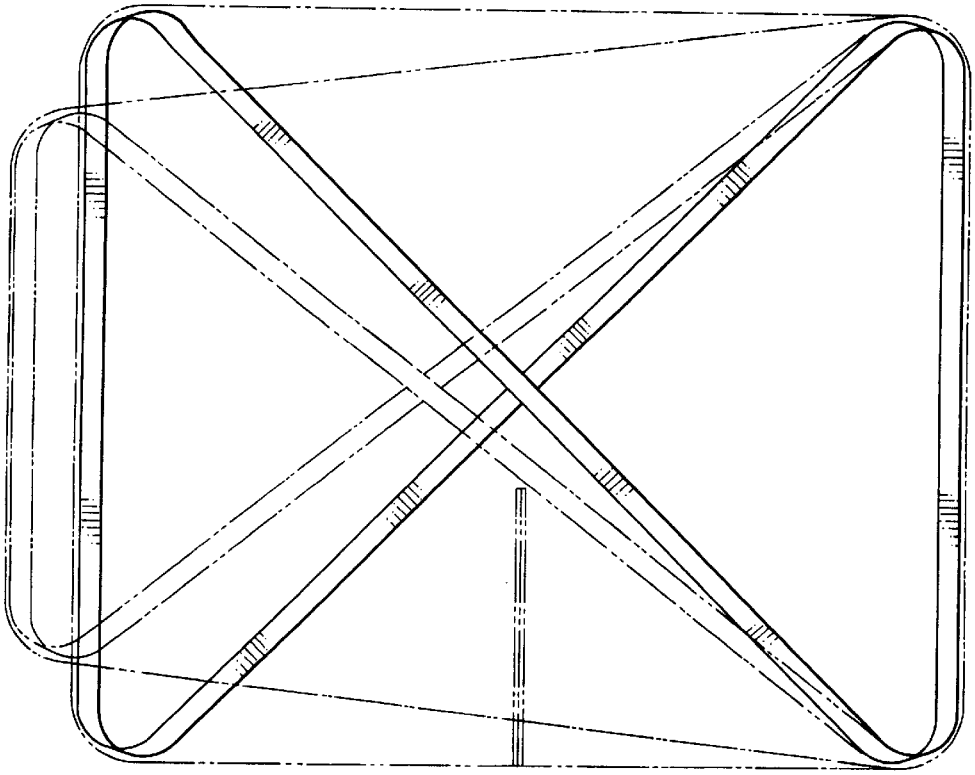
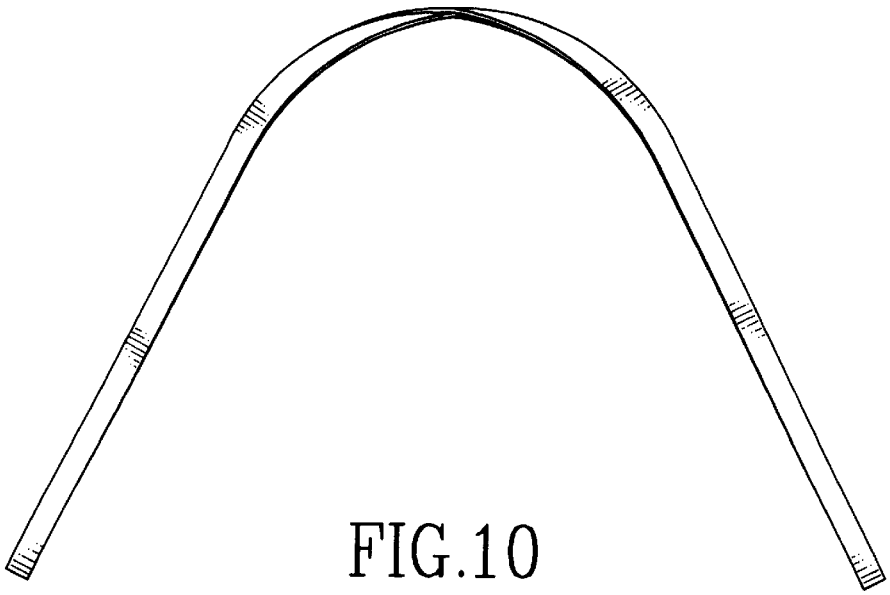
FIG.10
PRIOR ART

TENT FRAME

BACKGROUND OF THE INVENTION

1. Field of the Invention

The present invention relates to a tent frame and, more particularly, to an improved tent frame of superior stability, which can vary in configuration with respect to the terrain and facilitates an associated tent to form a large dome configuration comfortable to the user laying therein.

2. Description of Related Art

U.S. Pat. No. 3,990,463 discloses a frame made of a single metal loop twisted to form a substantially 8-shaped frame, as shown in FIG. 7. Another tent frame is disclosed in U.S. Pat. No. 4,825,892 that discloses a similar frame except that the frame has a flat portion formed to increase the stability of the tent, as shown in FIG. 8.

Each of the conventional frames is made of a single metal loop that has sufficient flexibility to be bent for storage, and the resiliency to fully recover to the initial shape when the frame is released, thereby simplifying the pitching and striking of a pop-up tent composed of the frame and the tent.

However, the conventional frames have the following disadvantages:

1. unacceptable stability:

Because the single metal loop is not secured at the intersection between the pair of top segments, the frame will easily be distorted, such as by wind hitting the tent, as shown in FIG. 9.

2. formation of a narrow dome:

Because the single metal loop is concave or curved downward in the immediate vicinity of the above-mentioned intersection, the tent coving the frame will form a narrow dome that is uncomfortable to person(s) in the tent.

3. incapable of varying in configuration relative to the topography:

Because of the single metal loop, the fully expanded frame is restricted by the tent, despite the topography, thereby restricting where the tent can be pitched.

Therefore, it is an objective of the invention to provide an improved tent frame to mitigate and/or obviate the aforementioned problems.

SUMMARY OF THE INVENTION

The object of the present invention is to provide a tent frame of superior stability.

Another object of the present invention is to provide a tent frame that forms a large dome in an associated tent that is comfortable to the user.

Still, another object of the present invention is to provide a tent frame that can vary in configuration relative to the topography.

Other objects, advantages and novel features of the invention will become more apparent from the following detailed description when taken in conjunction with the accompanying drawings.

BRIEF DESCRIPTION OF THE DRAWINGS

FIG. 4 is a top plan view of a tent using the tent frame of FIG. 1 in a substantially square configuration;

FIG. 6 is a side plan view of the tent frame of FIG. I forming a relatively large doom;

FIG. 9 is a top plan view of the conventional tent frame shown in FIG. 7; and FIG. 10 is a side view of the conventional tent frame shown in FIG. 8.

DETAILED DESCRIPTION OF PREFERRED EMBODIMENT

Figure 1:
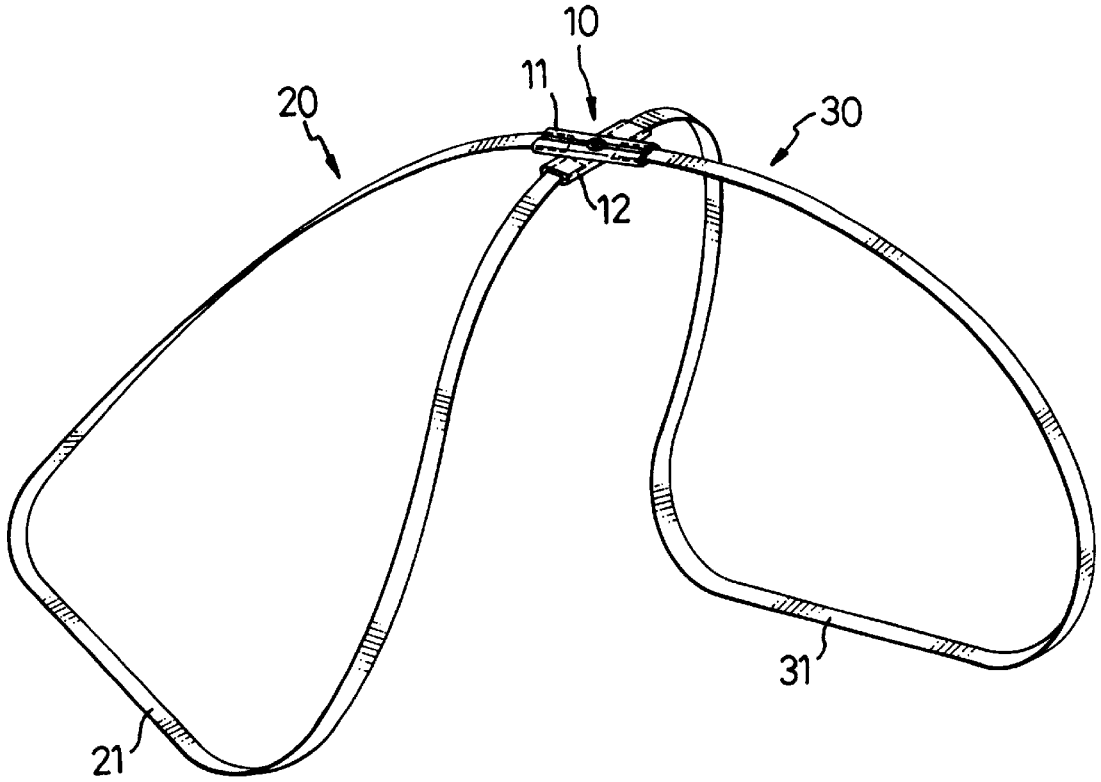
FIG. 1 is a perspective view of a preferred embodiment of a tent frame in accordance with the present invention.

Referring to FIG. 1, a preferred embodiment of a tent frame constructed in accordance with the present invention includes a connector (10) and a pair of curved flexible straps (20, 30).

The connector (10) has a first receptacle ( 11) and a second receptacle (12). The receptacles (11, 12) are arranged one above the other, and are pivotally connected to each other substantially at the midpoints.

Figure 2:
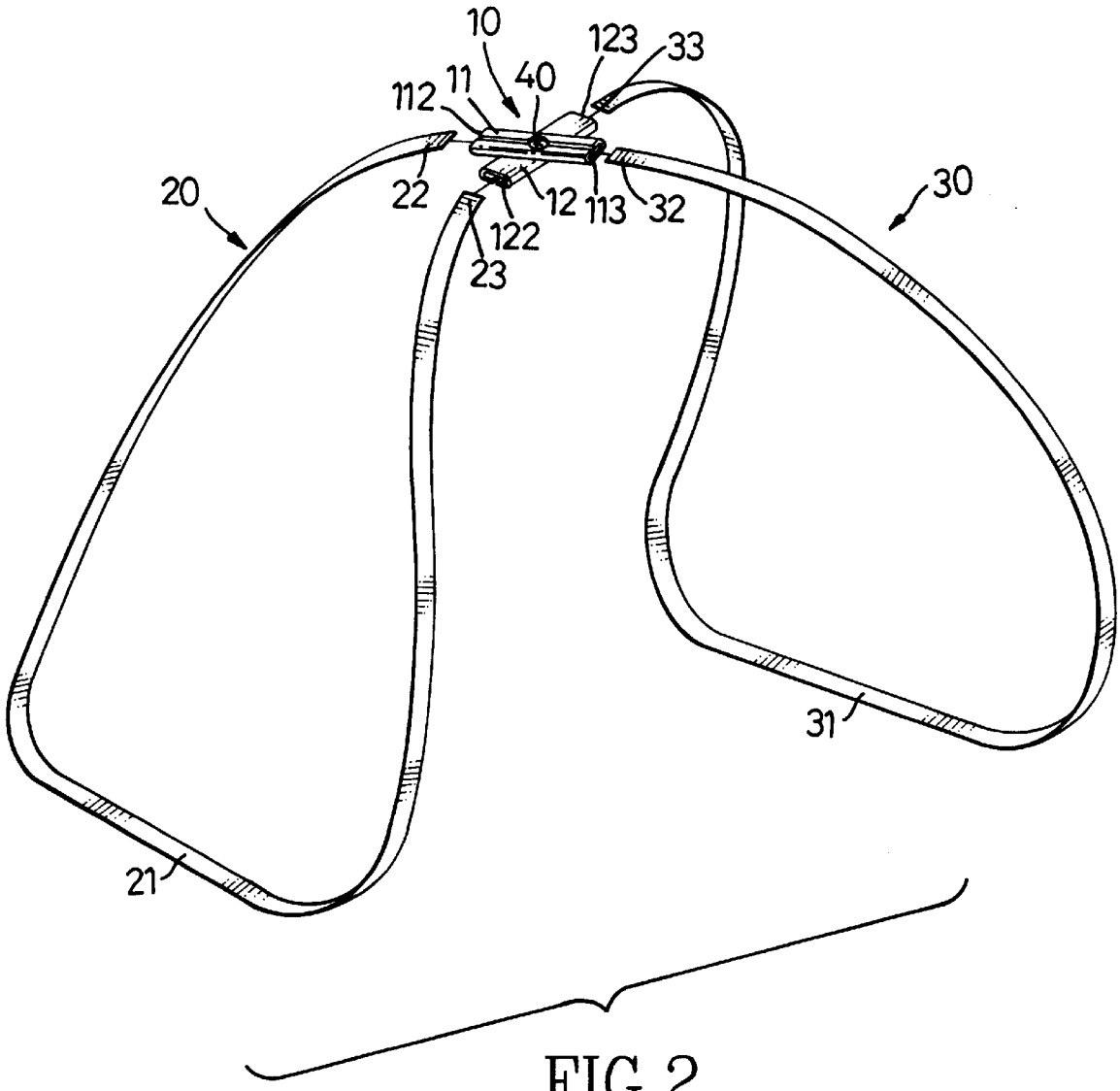
FIG. 2 is an exploded perspective view of the tent frame shown in FIG. 1.
Figure 3:
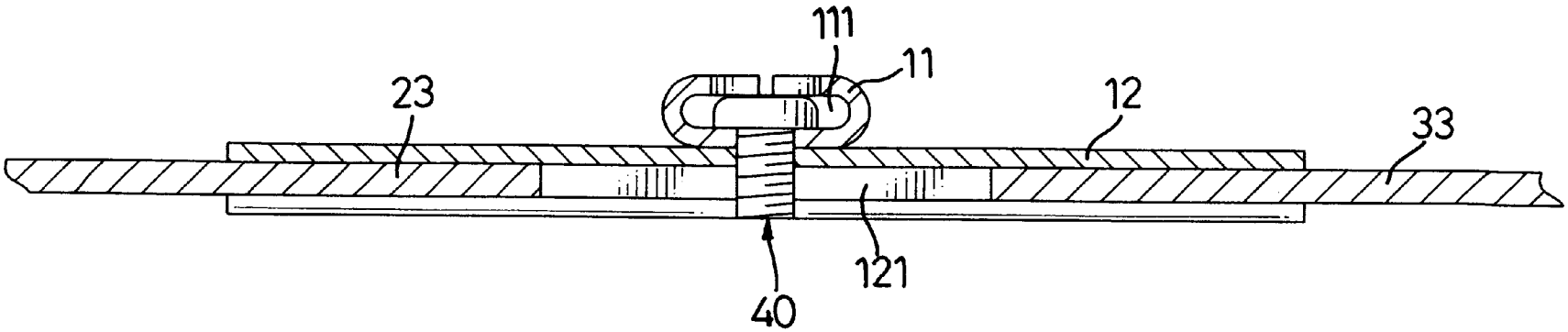
FIG. 3 is a cross sectional side plan view of a connector used in the tent frame of FIG. 1.

Referring to FIGS. 2 and. 3, in a preferred embodiment, the connector (10) has a coupling member (40), such as a screw, a rivet or the likes, that pivotally interconnects the receptacles (11, 12). Therefore, the receptacles (11, 12) can be pivoted relative to each other to form a desired angle therebetween.

The first receptacle ( 11) has a longitudinal channel (111), a first end (112) and a second end (113), and the second receptacle (12) has a longitudinal channel (121), a first end (122) and a second end (123).

The curved flexible strap (20) has a first end (22) inserted into the longitudinal channel (111) at the first end (112) of the first receptacle (11), and a second end (23) inserted into the longitudinal channel (121) at the first end (122) of the second receptacle (12).

Similarly, the other curved flexible strap (30) has a first end (32) inserted into the longitudinal channel (111) at the second end (113) of the first receptacle (11), and a second end (33) inserted into the longitudinal channel (121) at the second end (123) of the second receptacle (12).

In addition, each of the curved flexible straps (20, 30) is shaped, such as by machine, into a configuration that has a narrow top spacing between the ends (22, 23, or 32, 33) and a broad bottom heel (21, 31), as shown in FIGS. 1 and 2, thereby providing a stable tent frame and forming a large space sufficient to accommodate at least one user therein after the ends (22, 23, 32, 33) of the curved flexible straps (20, 30) are attached to the ends (112, 122, 113, 123) of the first and the second receptacles (11, 12) of the connector ( 10).

It is important that the curved flexible straps (20, 30) are made of a metal which has sufficient flexibility to be bent for storage and a resiliency to fully recover to the initial shape as is shown in FIG. 2.

Figure 5:
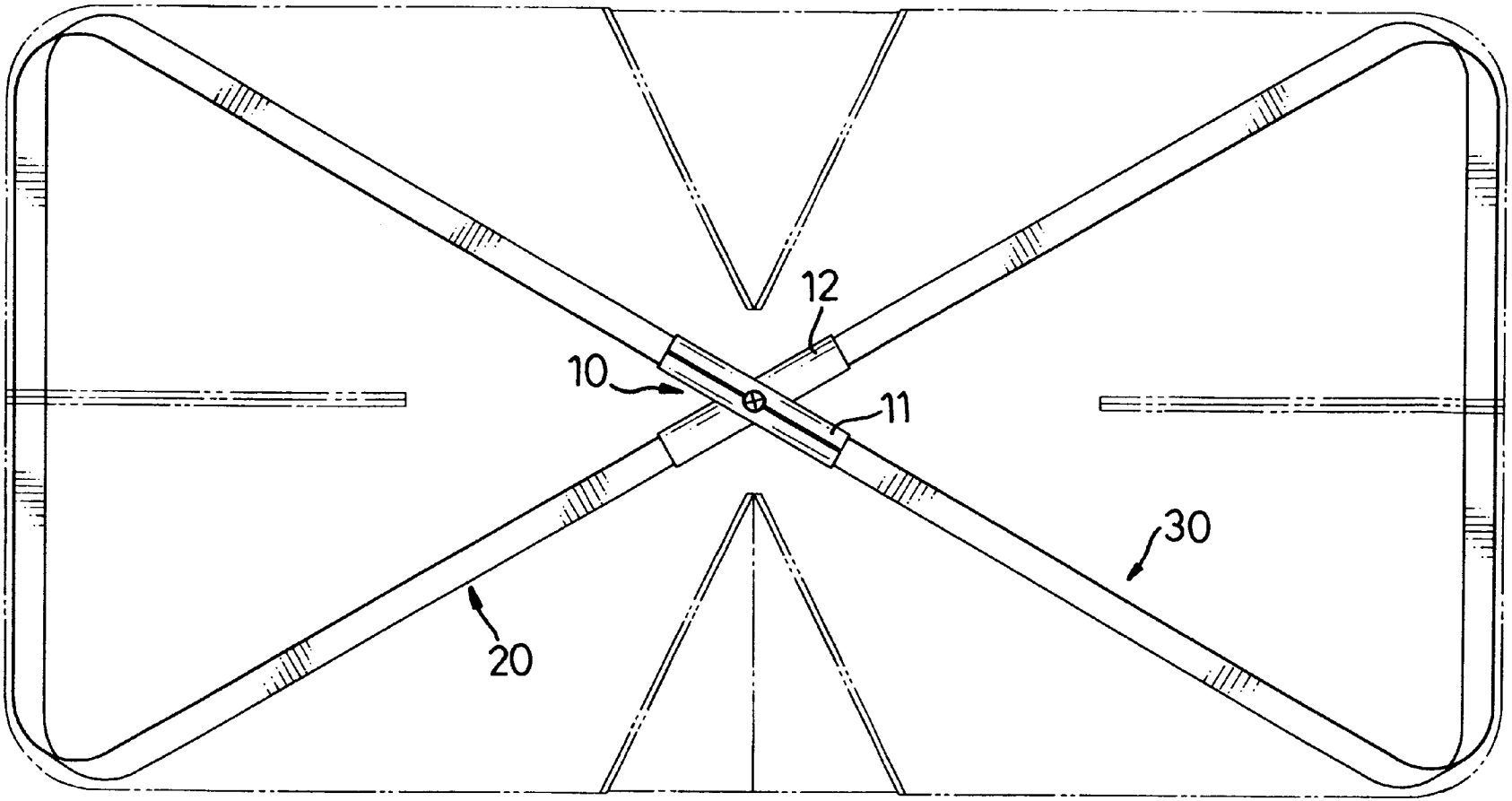
FIG. 5 is a top plan view of the tent of FIG. 4 in a rectangular configuration.
Figure 7:
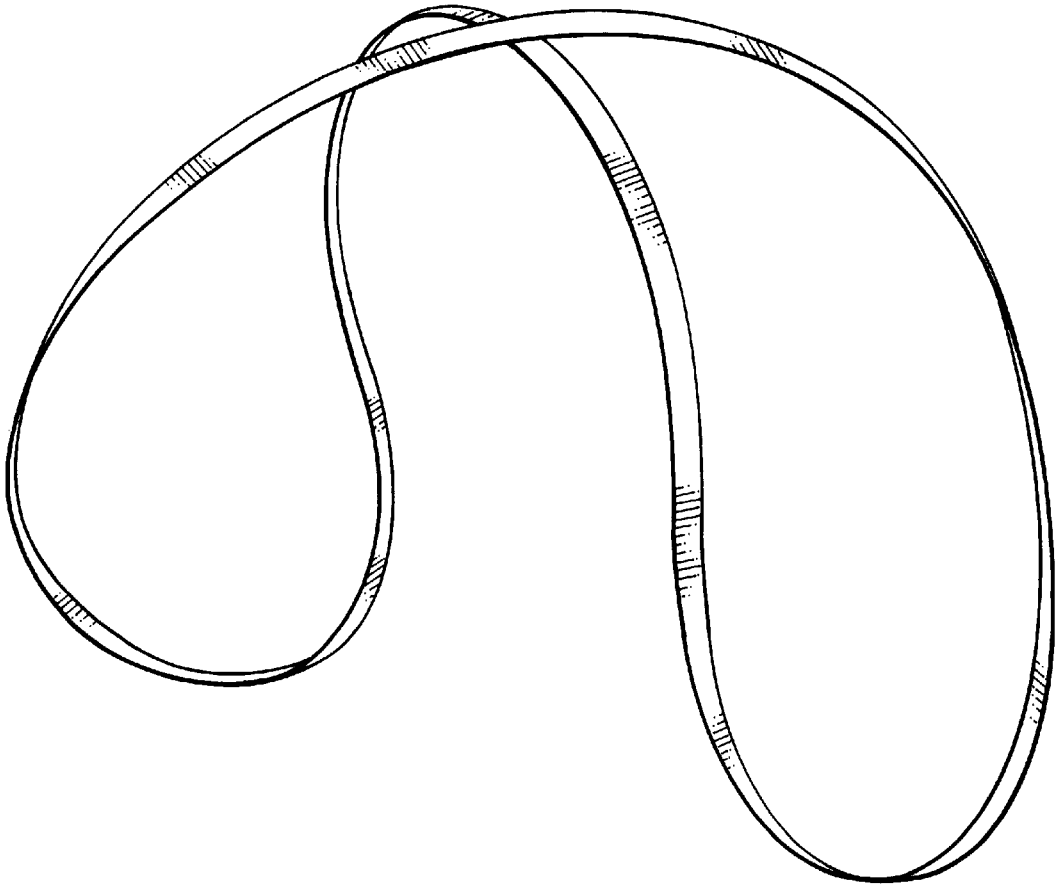
FIG. 7 PRIOR ART
FIG. 7 is a perspective view of the conventional tent frame disclosed in U.S. Pat. No. 3,990,463.
Figure 8:
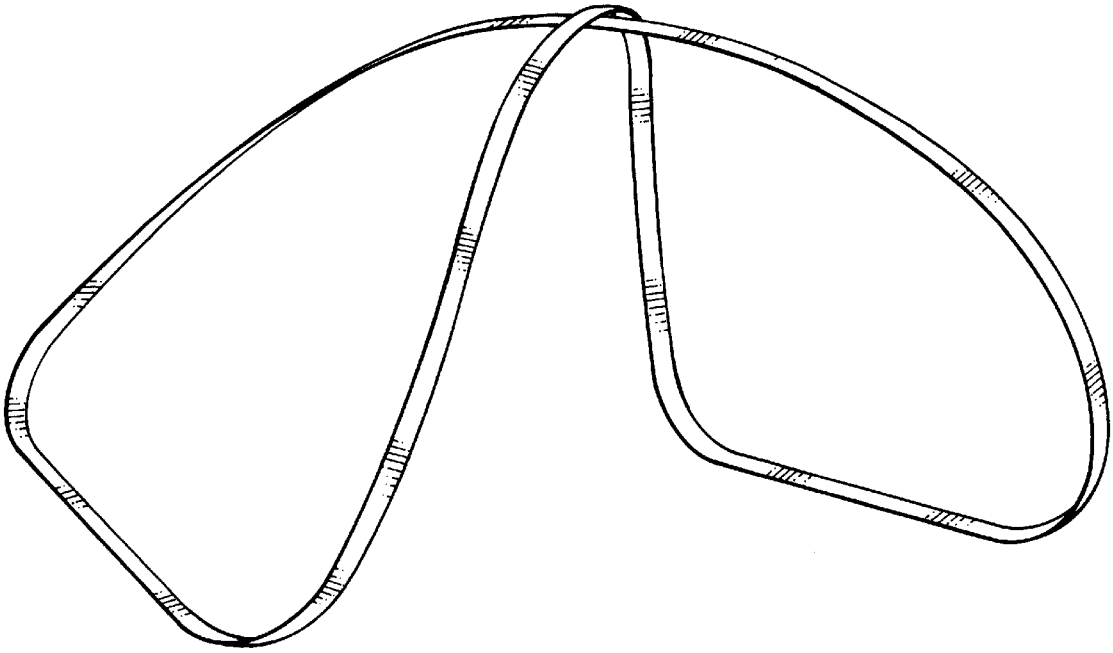
FIG.8 PRIOR ART
FIG. 8 is perspective view of a conventional tent frame disclosed in U.S. Pat. No. 4,825,892.

Referring to FIGS. 4 and 5, the tent frame of the present invention is used to support a tent (50) (in phantom line) to form a shelter for at least one user. It is preferable that the tent (50) has multiple zippers (51) arranged as illustrated, so that the tent frame covered with the tent (50) may vary in configuration with the zipping or unzipping of the zipper fasteners (51), as shown in FIGS. 4 and 5 respectively, to correspond to the terrain where the tent in accordance with the present invention is erected. It is to be noted that when the zipper fasteners (51) are provided on the tent (50), a part of the tent (50) is able to be folded and stretched to correspond to the operation of the zipper fasteners (51) to change the configuration of the tent (50). Since the receptacles (11, 12) can be pivoted with respect to each other, the tent (50) can be further configured to match the terrain.

In addition, the pivotal connection of the receptacles (11, 12) of the connector (10) prevents the tent from twisting unintentionally, such as by wind, thereby providing a more stable tent.

Referring to FIG. 6, the first and the second receptacles (11, 12) of the connector (10) additionally make the top portion of the assembled flexible metal straps (20, 30) flatter, which results in that a dome having a larger upper space than the conventional dome, wherein the space formed by the present invention is shown in solid line and the space formed by the conventional tent is shown in phantom lines, thereby providing a tent having a large inner space at the top thereof.

From the above description, it is noted that the invention has the following advantages:

1. being capable of varying in configuration relative to the topography of the tent site;

2. providing a tent frame of superior stability that prevents the associated tent from twisting unintentionally; and 3. forming a tent with a large dome that is more comfortable to the user(s).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tent frame comprising:

a connector (10) having a first receptacle (11) and a second receptacle (12);

said first receptacle (11) having a first end (112) and a second end (113), said second receptacle (12) having a first end (122) and a second end (123), said receptacles (11, 12) being pivotably connected to each other substantially at the midpoints;

a first curved flexible strap (20) having a first end (22) attachable to said first end (112) of said first receptacle (11) and a second end (23) attachable to said first end (122) of said second receptacle (12); and a second curved flexible strap (30) having a first end (32) attachable to said second end (113) of said first receptacle (11) and a second end (33) attachable to said second end (123) of said second receptacle (12);

wherein said curved flexible straps (20, 30) are configured so that an empty space sufficient to accommodate at least one user is formed between said curved flexible straps (20, 30) after said ends (22, 23, 332, 33) of said curved flexible straps (20, 30) are attached to said ends (112, 122, 113, 123) of said receptacles (11, 12) of said connector (10).

2. The tent frame as claimed in claim 1, wherein the connector (10) has an coupling member (40) for pivotally interconnecting said receptacles (11, 12) substantially at said midpoints thereof.

* * * * *